US007556334B2

(12) United States Patent
White et al.

(10) Patent No.: US 7,556,334 B2
(45) Date of Patent: Jul. 7, 2009

(54) METHODS AND APPARATUS FOR ALIGNING PRINT HEADS

(75) Inventors: John M. White, Hayward, CA (US); Fan Cheung Sze, San Jose, CA (US); Quanyuan Shang, Saratoga, CA (US); Shinichi Kurita, San Jose, CA (US); Hongbin Ji, Santa Clara, CA (US); Janusz Jozwiak, San Ramon, CA (US); Inchen Huang, Fremont, CA (US); Emanual Beer, San Jose, CA (US)

(73) Assignee: Applied Materials, Inc., Santa Clara, CA (US)

( * ) Notice: Subject to any disclaimer, the term of this patent is extended or adjusted under 35 U.S.C. 154(b) by 831 days.

(21) Appl. No.: 11/019,930

(22) Filed: Dec. 22, 2004

(65) Prior Publication Data

US 2006/0092199 A1 May 4, 2006

Related U.S. Application Data

(60) Provisional application No. 60/625,550, filed on Nov. 4, 2004.

(51) Int. Cl.

| | |
|---|---|
| ***B41J 29/393*** | (2006.01) |
| ***B05C 11/00*** | (2006.01) |
| ***B05B 7/06*** | (2006.01) |
| ***B05B 9/06*** | (2006.01) |
| ***B05D 5/06*** | (2006.01) |

(52) U.S. Cl. ..... 347/19; 118/712; 118/323; 118/313; 427/162

(58) Field of Classification Search ..... 347/19; 118/712, 323, 313; 427/162

See application file for complete search history.

(56) References Cited

U.S. PATENT DOCUMENTS

| | | | |
|---|---|---|---|
| 4,571,601 | A | 2/1986 | Teshima |
| 4,987,043 | A | 1/1991 | Roosen et al. |
| 5,114,760 | A | 5/1992 | Takemura et al. |
| 5,177,627 | A | 1/1993 | Ishiwata et al. |
| 5,232,634 | A | 8/1993 | Sawada et al. |
| 5,232,781 | A | 8/1993 | Takemura et al. |
| 5,264,952 | A | 11/1993 | Fukutani et al. |
| 5,340,619 | A | 8/1994 | Chen et al. |
| 5,399,450 | A | 3/1995 | Matsushima et al. |
| 5,432,538 | A | 7/1995 | Carlotta |
| 5,552,192 | A | 9/1996 | Kashiwazaki et al. |
| 5,554,466 | A | 9/1996 | Matsushima et al. |

(Continued)

FOREIGN PATENT DOCUMENTS

| | | |
|---|---|---|
| DE | 1 218 473 | 6/1966 |

(Continued)

*Primary Examiner*—Julian D Huffman
(74) *Attorney, Agent, or Firm*—Dugan & Dugan, PC

(57) ABSTRACT

In a first aspect, a system is provided. The system includes (1) a stage adapted to move a substrate relative to print heads during printing; (2) at least one print head suspended from a support above the stage and adapted to be moveable in a plane above the stage; (3) a controller operable to rotate the print head about a center of the print head; and (4) an imaging system adapted to capture an image of the print head and to determine a center point of the print head based upon images of the print head captured as the print head is rotated. Numerous other aspects are provided.

18 Claims, 3 Drawing Sheets

U.S. PATENT DOCUMENTS 5,593,757 A 1/1997 Kashiwazaki et al.
5,626,994 A 5/1997 Takayanagi et al.
5,648,198 A 7/1997 Shibata
5,702,776 A 12/1997 Hayase et al.
5,705,302 A 1/1998 Ohno et al.
5,714,195 A 2/1998 Shiba et al.
5,716,739 A 2/1998 Kashiwazaki et al.
5,716,740 A 2/1998 Shiba et al.
5,726,724 A 3/1998 Shirota et al.
5,748,266 A 5/1998 Kodate
5,757,387 A 5/1998 Manduley
5,811,209 A 9/1998 Eida et al.
5,817,441 A 10/1998 Iwata et al.
5,831,704 A 11/1998 Yamada et al.
5,847,735 A 12/1998 Betschon
5,880,799 A 3/1999 Inoue et al.
5,895,692 A 4/1999 Shirasaki et al.
5,916,713 A 6/1999 Ochiai et al.
5,916,735 A 6/1999 Nakashima et al.
5,922,401 A 7/1999 Kashiwazaki et al.
5,948,576 A 9/1999 Shirota et al.
5,948,577 A 9/1999 Nakazawa et al.
5,956,063 A 9/1999 Yokoi et al.
5,962,581 A 10/1999 Hayase et al.
5,968,688 A 10/1999 Masuda et al.
5,969,780 A 10/1999 Matsumoto et al.
5,984,470 A 11/1999 Sakino et al.
5,989,757 A 11/1999 Satoi
6,013,415 A 1/2000 Sakurai et al.
6,025,898 A 2/2000 Kashiwazaki et al.
6,025,899 A 2/2000 Fukunaga et al.
6,042,974 A 3/2000 Iwata et al.
6,063,527 A 5/2000 Nishikawa et al.
6,066,357 A 5/2000 Tang et al.
6,071,989 A 6/2000 Sieber et al.
6,078,377 A 6/2000 Tomono et al.
6,087,196 A 7/2000 Sturm et al.
6,134,059 A 10/2000 Shirota et al.
6,140,988 A 10/2000 Yamada
6,142,604 A 11/2000 Kanda et al.
6,145,981 A 11/2000 Akahira et al.
6,149,257 A 11/2000 Yanaka et al.
6,153,711 A 11/2000 Towns et al.
6,154,227 A 11/2000 Lund
6,158,858 A 12/2000 Fujiike et al.
6,162,569 A 12/2000 Nakashima et al.
6,196,663 B1 3/2001 Wetchler et al.
6,211,347 B1 4/2001 Sieber et al.
6,224,205 B1 5/2001 Akahira et al.
6,226,067 B1 5/2001 Nishiguchi et al.
6,228,435 B1 5/2001 Yoshikawa et al.
6,234,626 B1 5/2001 Axtell et al.
6,242,139 B1 6/2001 Hedrick et al.
6,244,702 B1 6/2001 Sakino et al.
6,264,322 B1 7/2001 Axtell et al.
6,270,930 B1 8/2001 Okabe
6,271,902 B1 8/2001 Ogura et al.
6,277,529 B1 8/2001 Marumoto et al.
6,281,960 B1 8/2001 Kishimoto et al.
6,312,771 B1 11/2001 Kashiwazaki et al.
6,322,936 B1 11/2001 Nishikawa et al.
6,323,921 B1 11/2001 Kurauchi et al.
6,331,384 B1 12/2001 Satoi
6,341,840 B1 1/2002 van Doorn et al.
6,344,301 B1 2/2002 Akutsu et al.
6,356,357 B1 3/2002 Anderson et al.
6,358,602 B1 3/2002 Horiuchi et al.
6,367,908 B1 4/2002 Serra et al.
6,384,528 B1 5/2002 Friend et al.
6,384,529 B2 5/2002 Tang et al.
6,386,675 B2 5/2002 Wilson et al.
6,392,728 B2 5/2002 Tanaka et al.
6,392,729 B1 5/2002 Izumi et al.
6,399,257 B1 6/2002 Shirota et al.
6,417,908 B2 7/2002 Nishiguchi et al.
6,424,393 B1 7/2002 Hirata et al.
6,424,397 B1 7/2002 Kuo
6,426,166 B2 7/2002 Nishikawa et al.
6,428,135 B1 8/2002 Lubinsky et al.
6,428,151 B1 8/2002 Yi et al.
6,429,601 B1 8/2002 Friend et al.
6,429,916 B1 8/2002 Nakata et al.
6,433,852 B1 8/2002 Sonoda et al.
6,450,635 B1 9/2002 Okabe et al.
6,455,208 B1 9/2002 Yamashiki et al.
6,462,798 B1 10/2002 Kim et al.
6,464,329 B1 10/2002 Koitabashi et al.
6,464,331 B1 10/2002 van Doorn et al.
6,468,702 B1 10/2002 Yi et al.
6,475,271 B2 11/2002 Lin
6,476,888 B2 11/2002 Yamanashi
6,480,253 B1 11/2002 Shigeta et al.
6,498,049 B1 12/2002 Friend et al.
6,508,533 B2 1/2003 Tsujimoto et al.
6,518,700 B1 2/2003 Friend et al.
6,557,984 B2 5/2003 Tanaka et al.
6,569,706 B2 5/2003 Pakbaz et al.
6,580,212 B2 6/2003 Friend
6,627,364 B2 9/2003 Kiguchi et al.
6,630,274 B1 10/2003 Kiguchi et al.
6,667,795 B2 12/2003 Shigemura
6,686,104 B1 2/2004 Shiba et al.
6,692,983 B1 2/2004 Chen et al.
6,693,611 B1 2/2004 Burroughes
6,695,905 B2 2/2004 Rozumek et al.
6,698,866 B2 3/2004 Ward et al.
6,705,694 B1 3/2004 Barbour et al.
6,738,113 B2 5/2004 Yu et al.
6,762,234 B2 7/2004 Grizzi
2001/0012596 A1 8/2001 Kunimoto et al.
2002/0054197 A1 5/2002 Okada et al.
2002/0081376 A1 6/2002 Yonehara
2002/0128515 A1 9/2002 Ishida et al.
2002/0144422 A1* 10/2002 Suhara et al. ..... 33/613
2003/0025446 A1 2/2003 Lin et al.
2003/0030715 A1 2/2003 Cheng et al.
2003/0039803 A1 2/2003 Burroughes
2003/0076454 A1 4/2003 Burroughes
2003/0117455 A1 6/2003 Bruch et al.
2003/0118921 A1 6/2003 Chen et al.
2003/0171059 A1 9/2003 Kawase et al.
2003/0189604 A1 10/2003 Bae et al.
2003/0189606 A1* 10/2003 Moon et al. ..... 347/2
2003/0218645 A1 11/2003 Dings et al.
2003/0222927 A1 12/2003 Koyama
2003/0224621 A1 12/2003 Ostergard et al.
2004/0008243 A1 1/2004 Sekiya
2004/0018305 A1 1/2004 Pagano et al.
2004/0023567 A1 2/2004 Koyama et al.
2004/0041155 A1 3/2004 Grzzi et al.
2004/0075383 A1 4/2004 Endo et al.
2004/0075789 A1 4/2004 Wang
2004/0086631 A1 5/2004 Han et al.
2004/0094768 A1 5/2004 Yu et al.
2004/0097101 A1 5/2004 Kwong et al.
2004/0097699 A1 5/2004 Holmes et al.
2004/0109051 A1 6/2004 Bright et al.
2004/0125181 A1 7/2004 Nakamura
2004/0218002 A1 11/2004 Nakamura

FOREIGN PATENT DOCUMENTS

EP 1 557 270 A1 7/2005
JP 59-075205 4/1984

| | | |
|---|---|---|
| JP | 61-245106 | 10/1986 |
| JP | 63-235901 | 9/1988 |
| JP | 63-294503 | 12/1988 |
| JP | 01-277802 | 11/1989 |
| JP | 02-173703 | 7/1990 |
| JP | 02-173704 | 7/1990 |
| JP | 07-198924 | 8/1995 |
| JP | 08-160219 | 6/1996 |
| JP | 10-039130 | 2/1998 |
| JP | 2002-277622 | 9/2002 |
| JP | 2003-303544 | 10/2003 |
| JP | 2004-077681 | 3/2004 |
| WO | WO 03/045697 A1 | 6/2003 |

* cited by examiner

METHODS AND APPARATUS FOR ALIGNING PRINT HEADS

The present application claims priority to commonly-assigned, co-pending U.S. Provisional Patent Application Ser. No. 60/625,550, filed Nov. 4, 2004 and entitled "APPARATUS AND METHODS FOR FORMING COLOR FILTERS IN A FLAT PANEL DISPLAY BY USING INKJETTING" which is hereby incorporated herein by reference in its entirety for all purposes.

CROSS REFERENCE TO RELATED APPLICATIONS

The present application is related to the following commonly-assigned, co-pending U.S. Patent Applications, each of which is hereby incorporated herein by reference in its entirety for all purposes:

U.S. patent application Ser. No. 11/019,929, filed Dec. 22, 2004 and titled "APPARATUS AND METHODS FOR AN INKJET HEAD SUPPORT HAVING AN INKJET HEAD CAPABLE OF INDEPENDENT LATERAL MOVEMENT"; and U.S. patent application Ser. No. 11/019,929, filed Dec. 22, 2004 and titled "METHODS AND APPARATUS FOR INKJET PRINTING".

FIELD OF THE INVENTION

The present invention relates generally to electronic device manufacturing and systems for printing, and is more particularly concerned with apparatus and methods for aligning inkjet printing heads.

BACKGROUND OF THE INVENTION

The flat panel display industry has been attempting to employ inkjet printing to manufacture display devices, in particular, color filters. One problem with effective employment of inkjet printing is that it is difficult to inkjet ink or other material accurately and precisely on a substrate while having high throughput.

The accuracy of an inkjet printing system may be influenced by the precision of the physical components used in constructing the system and the degree to which corrections are applied to the system to accommodate a collective error effect of aggregating multiple components that individually may be within tolerances. In some cases, as a system wears or is subjected to stress or climatic changes, the accuracy of the system may decline. Thus, what is needed are systems and methods for efficiently and automatically calibrating key components of an inkjet print system, including the position of the inkjet heads.

SUMMARY OF THE INVENTION

In a first aspect of the invention, a system is provided. The system includes (1) a stage adapted to move a substrate relative to print heads during printing; (2) at least one print head suspended from a support above the stage and adapted to be moveable in a plane above the stage; (3) a controller operable to rotate the print head about a center of the print head; and (4) an imaging system adapted to capture an image of the print head and to determine a center point of the print head based upon images of the print head captured as the print head is rotated.

In a second aspect of the invention, a first apparatus is provided. The first apparatus includes (1) a camera adapted to capture images of a print head; (2) a processor coupled to the camera and operable to store images of the print head from the camera; and (3) a memory coupled to the processor and adapted to store processor instructions to capture an image of the print head and to determine a center point of the print head based upon images of the print head captured as the print head is rotated.

In a third aspect of the invention, a second apparatus is provided. The second apparatus includes (1) a camera adapted to capture images of a print head; (2) a processor coupled to the camera and operable to store images of the print head from the camera; and (3) a memory coupled to the processor and adapted to store processor instructions to (a) transmit a print head rotation request to a print head drive mechanism; (b) identify at least two nozzles on the print head that trace substantially similar circular paths phase shifted by 180° on a horizontal plane above the camera as the print head is rotated; (c) determine a center point of the print head based upon the two nozzles; and (d) calibrate the print head drive mechanism based on the determined center point.

In a fourth aspect of the invention, a third apparatus is provided. The third apparatus includes (1) a stage adapted to move a substrate relative to print heads during printing; (2) a plurality of print head carriages suspended from a support above the stage and adapted to be moveable in a plane above the stage; (3) a print head drive mechanism operable to move the print head carriages relative to the support; and (4) a camera mounted in one of the print head carriages in place of a print head and adapted to couple to an imaging system.

In a fifth aspect of the invention, a first method is provided. The first method includes the steps of (1) transmitting a print head rotation request to a print head drive mechanism; (2) capturing images of the print head as the print head is rotated; and (3) determining a center point of the print head based upon the images. Numerous other aspects are provided in accordance with these and other aspects of the invention.

Other features and aspects of the present invention will become more fully apparent from the following detailed description of exemplary embodiments, the appended claims and the accompanying drawings.

DETAILED DESCRIPTION

The present invention provides methods and apparatus to precisely calibrate a position and orientation control mechanism of a print head for an inkjet printing system. The precise calibration of a print head positioning control mechanism may be desirable because the nozzle to nozzle spacing of a print head may not match the display pixel pitch of a display object to be printed. Rotation of the print head along its center axis may allow each nozzle to be aligned with the center of a display pixel to be printed.

Through the use of an imaging system, a center point of the print head may be located. In one or more embodiments, this may be achieved by rotating the print head in a horizontal plane about the print head's center over a fixed camera of the imaging system. For example, the camera may be aimed upward and mounted to a stationary portion (e.g., a frame) of a stage used to move a substrate under the print head during printing. Other camera locations and/or orientations may be used, such as a camera aimed downward at an inverted print head.

Pattern recognition software of the imaging system may be employed to identify any two nozzles of the print head that trace substantially similar circular paths phase shifted by 180° on the horizontal plane as the print head is rotated. Once the two nozzles have been identified, a point that is approximately equidistant from and between the two identified nozzles, may be regarded as the center point of the print head. The present invention thus facilitates alignment of the center point of the print head to the rotational axis of the print head.

In addition, a line projected between the identified nozzles may be compared against one or more reference lines of known orientations to determine the rotational orientation or alignment of the print head.

In some embodiments, a second camera may be aimed downward and mounted on a support or print head carriage conventionally used to carry a print head. Such a camera may be employed to align a substrate on the stage using alignment marks on the substrate, to help determine ink drop locations, and/or to help calculate offsets for print head positioning. Additional other aspects and/or embodiments are described in detail below.

Figure 1:
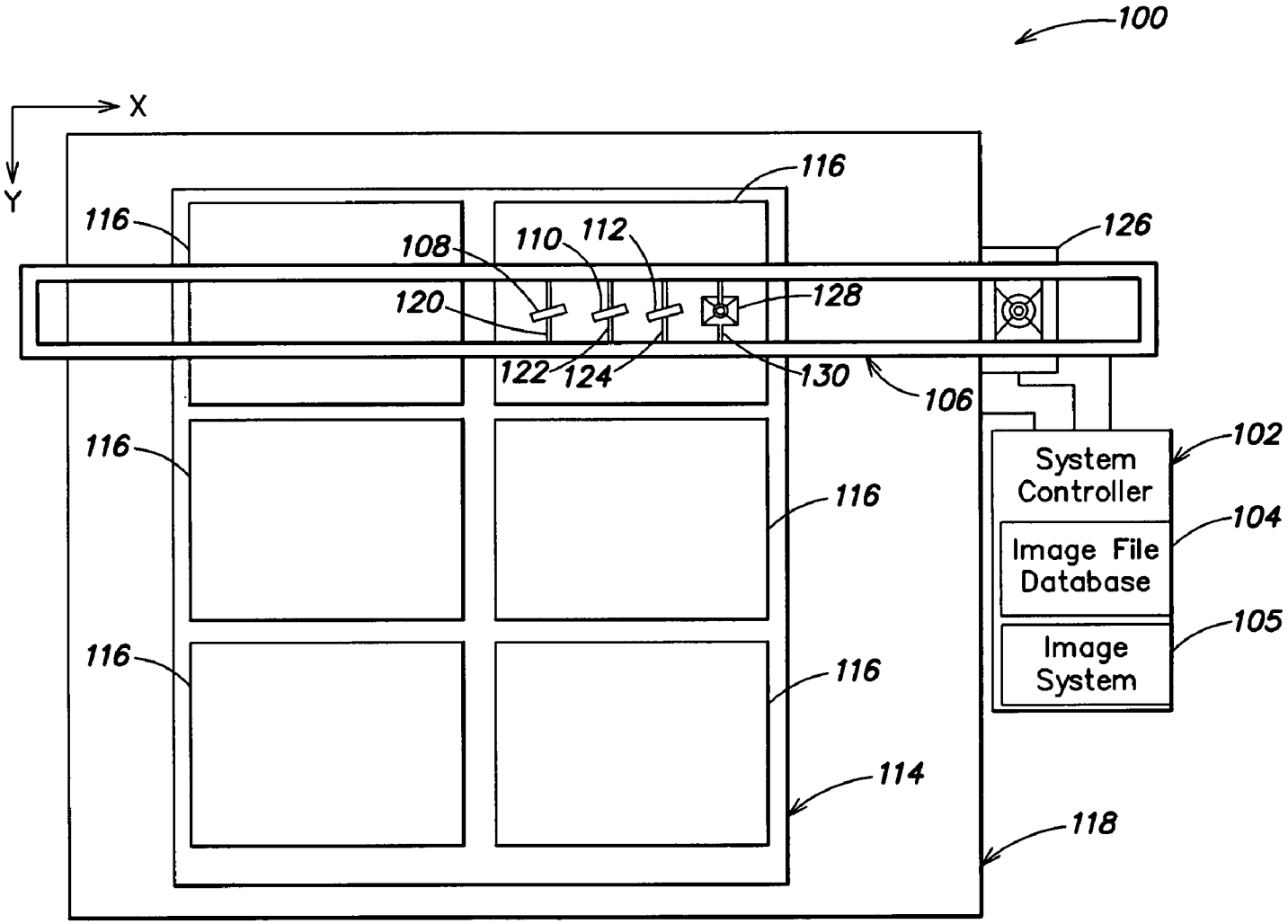
FIG. 1 is a top view of an inkjet printing system according to some embodiments of the present invention.

FIG. 1 illustrates a top view of an embodiment of a system of the present invention which is designated generally by the reference numeral 100. The inkjet printing system 100 of the present invention, in an exemplary embodiment, may include a system controller 102, an image file database 104, and an imaging system 105. Both the image file database 104 and the imaging system 105 may be integral components of the system controller 102 or both the image file database 104 and the imaging system 105 may be separate external devices. The image file database 104 may store data adapted to be used by the system 100 to print an image. The system 100 may also include a print head support 106. The system controller 102 may be logically (e.g., electrically) and/or mechanically coupled to the print head support 106.

In the exemplary embodiment of FIG. 1, the print head support 106 includes three print heads which from left to right are designated by the reference numerals 108, 110, and 112, respectively. Although only three print heads are shown in FIG. 1, it is important to note that any number of print heads may be mounted on and/or used in connection with the print head support 106. The print head support 106 may include motors, carriages, and/or other drive mechanisms 120, 122, 124 to move (e.g., laterally and/or rotationally) the print heads 108, 110, 112.

Each of the print heads 108, 110, 112 may print any color ink or may dispense an other fluid. In an exemplary embodiment, a respective print head 108 may be used for printing red ink, green ink, and/or blue ink. Each print head 108, 110, 112 may also be used for printing other color inks, such as, but not limited to, cyan, yellow, magenta, white, and/or clear inks.

In one or more exemplary embodiments, each of the print heads 108, 110, 112 may be independently moveable in one or more lateral directions relative to another of the print heads 108, 110, and 112 along the print head support 106. In another exemplary embodiment, each of the print heads 108, 110, 112 may be independently rotatable relative to the print head support 106. The print head support 106, including the drive mechanisms 120, 122, 124, may be coupled logically (e.g., electrically) and/or mechanically with each of the print heads 108, 110, and 112. The system controller 102 may be coupled to the print head support 106 and to each of the drive mechanisms 120, 122, 124, and print heads 108, 110, 112 so as to control and monitor the operation and movement of each of the print heads 108, 110, 112.

FIG. 1 also shows a substrate 114, such as a substrate used in manufacturing display panels and/or flat panel displays and/or color filters and/or other semiconductor devices which involve an ink jetting process in their manufacture. The substrate 114 may be comprised of glass, polymer(s), semiconductor material, and/or any other material that is practicable. In FIG. 1, the substrate 114 is shown including a plurality of display objects 116. In one or more exemplary embodiments, the substrate 114 may contain one or more display objects 116.

The substrate 114 may be supported by a stage 118. During a printing pass, the substrate 114 may be moved by the stage 118 under the print heads 108, 110, 112 as ink is dispensed onto the display objects 116. The stage 118 may also be coupled to the system controller 102. The system controller 102 may control movement of the stage 118 in directions along both the X-axis and the Y-axis. Note that FIG. 1 also shows a selected X-axis and Y-axis frame of reference.

As noted above, the system 100, in an exemplary embodiment, may include a system controller 102. The system controller 102 may be any suitable computer or computer system, including, but not limited to a mainframe computer, a minicomputer, a network computer, a personal computer, and/or any suitable processing device, component, or system. The system controller 102 may be adapted to control any of the print heads 108, 110, 112 through the print head support 106, including controlling the movement of the print heads 108, 110, 112 rotationally and in both positive and negative lateral displacement directions along the X-axis; the positive X-axis direction being indicated by the frame of reference arrow labeled X. The system controller 102 may also control any and all inkjet printing and maintenance operations capable of being performed by the print head support 106 and/or the print heads 108, 110, 112. The system controller 102 may also control any and all imaging system 105 functions.

In an exemplary embodiment, the image file database 104 may contains data and/or information regarding any of the substrate 114 and/or display objects 116 which may be manufactured using the system 100. The image file database 104 may, for example, include information which may be utilized by the system controller 102 to control the movement as well as the printing operations of each of the print head support 106, the drive mechanisms 120, 122, 124, the print heads 108, 110, 112, and the stage 118, so as to perform any and/or all requisite printing passes over the display objects 116 and/or substrate 114. The system controller 102 may, for example, control the entire printing operation on and for any given display object 116 and/or substrate 114 by utilizing information stored in the image file database 104.

The inkjet printing system 100 according to the present invention may also include a camera 126 mounted to a frame (not pictured) of the stage 118. The camera 126 may include an imaging system and/or may be coupled to the system controller 102 that may include software to implement an imaging system 105 within the system controller 102. The camera 126 may be mounted at or below the level of the substrate support surface of the stage 118 and aimed upward so as to be able to automatically focus on and capture images of the bottom of the print heads 108, 110, 112. In some embodiments, the camera 126 may be positioned below an opening in the substrate support surface of stage 118 and, as depicted in FIG. 1, in some embodiments, the camera 126 may be positioned adjacent to the stage 118. The camera may also be offset from the stage 118.

An example of a camera 126 including an imaging system 105 that may be suitable for use with the present invention may include the model CDC-200 Camera coupled to a model MVS-8100D Frame Grabber and associated software commercially available from Cognex Corporation of Natick, Mass. In some embodiments, the camera 126 may include an automatic focus feature, a 100× to 200× zoom lens (e.g., a microscope lens), computer interface logic, and/or automation software. Other camera and/or camera systems including analog and/or digital CCD-based cameras or any other suitable sensor and/or detector device may be used.

In some additional or alternative embodiments, the inkjet printing system 100 may additionally include a second camera 128 mounted on the print head support 106 via a drive mechanism including a carriage 130. This camera 128 may also include an imaging system 105 that is coupled to or part of the system controller 102. In some embodiments, this camera 128 may be aimed downward at the substrate 114 and mounted in a position conventionally used to carry a print head. Such a camera 128 may be employed to align a substrate 114 on the stage 118 using alignment marks on the substrate 114, to help determine ink drop locations, and/or to help calculate offsets for print head positioning. As with the first camera 126, the second camera 128 may be a model CDC-200 Camera coupled to a model MVS-8100D Frame Grabber that includes an automatic focus feature, a 100× to 200× zoom lens (e.g., a microscope lens), computer interface logic, and/or automation software. Other camera and/or camera systems including analog and/or digital CCD-based cameras or any other suitable sensor and/or detector device may be used.

Figure 2:
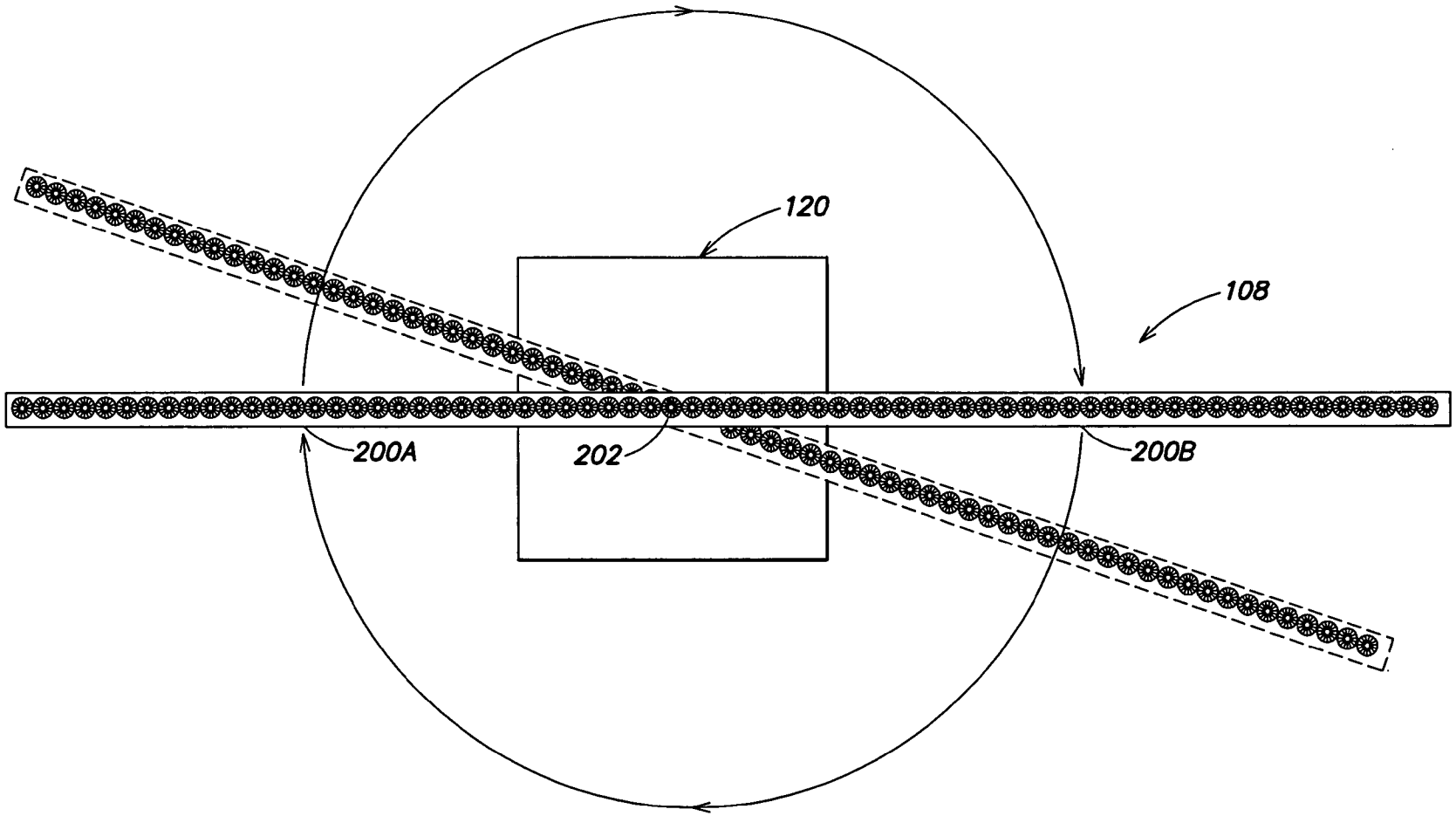
FIG. 2 is a bottom view of a print head according to and for use with some embodiments of the present invention.

Turning to FIG. 2, a bottom view of an example embodiment of a print head 108 is depicted. Such a print head 108 may include any number of nozzles 200A, 200B (only two are labeled). In some embodiments, a print head 108 may include one hundred twenty eight nozzles 200A, 200B that may each be independently fired. An example of a commercially available print head suitable for use with the present invention is the model SX-128, 128-Channel Jetting Assembly manufactured by Spectra, Inc. of Lebanon, N.H. This particular jetting assembly includes two electrically independent piezoelectric slices, each with sixty-four addressable channels, which are combined to provide a total of 128 jets. The nozzles are arranged in a single line, at a 0.020" distance between nozzles. The nozzles are designed to dispense drops from 10 to 12 picoliters but may be adapted to dispense a broader range of drop sizes, for example, 10 to 30 picoliters. Other print heads with differently sized nozzles may also be used.

The print head 108 may be rotated about a center point 202 by a drive mechanism 120 which, as indicated above, may be coupled directly, or indirectly via the print head support 106 (FIG. 1), to the system controller 102 (FIG. 1).

Figure 3:
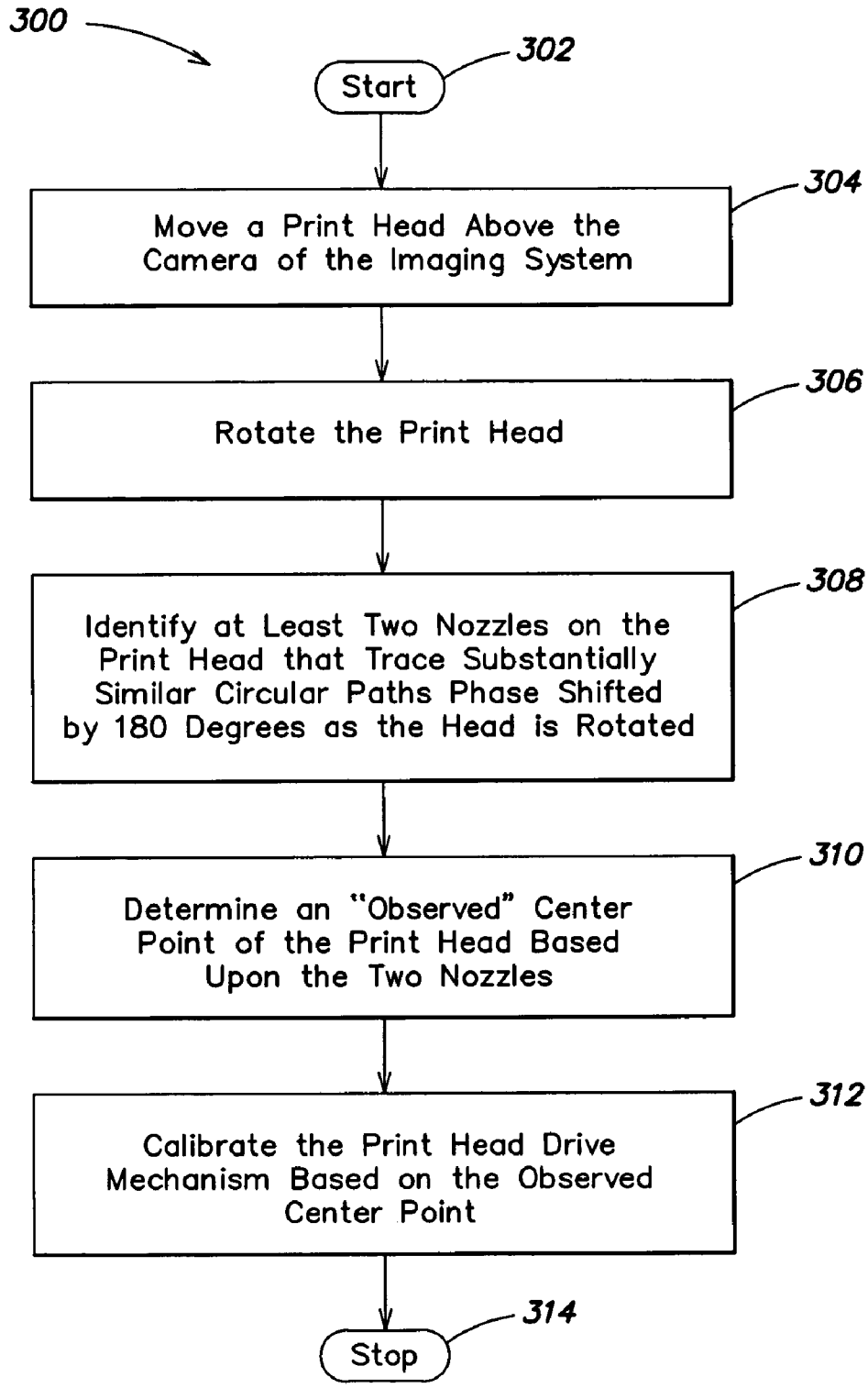
FIG. 3 is a flowchart illustrating an example of a method of aligning a print head according to some embodiments of the present invention.

Turning to FIG. 3, a flowchart depicting an example embodiment of a method 300 of aligning a print head according to the present invention is illustrated. The example method 300 begins at step 302. In Step 304, a print head 108 may be moved via the print head support 106 above an upward facing camera 126 of an imaging system 105. Note that in some embodiments, the orientation of the print head 108 may be different or changed and thus, the camera 126 may be positioned differently. In some embodiments, this step may simply involve the system controller 102 automatically issuing a command or transmitting a signal to the drive mechanism 120 and/or the print head support 106 to move the print head 108 above the camera 126 once an alignment process has been initiated. In other embodiments, an operator may manually move the print head 108 above the camera 126.

In step 306, the print head 108 may be rotated. In some embodiments, as with step 304, this step may simply involve the system controller 102 automatically issuing a command or transmitting a signal to the drive mechanism 120 and/or the print head support 106 to rotate the print head 108 once an alignment process has been initiated. In other embodiments, an operator may manually rotate the print head 108.

Once the print head 108 is rotating above the camera 126, in step 308 the camera 126 may capture images of the bottom view of the print head 108 as depicted in FIG. 2. Note that the representation of the print head 108 shown in phantom in FIG. 2 merely indicates an example of a rotated position of the print head 108. The imaging system 105 may compare the captured images to identify pairs of nozzles 200A, 200B that are tracing the substantially same circular path (as indicated by the arc arrows in FIG. 2) as the print head 108 is being rotated by the drive mechanism 120. An imaging system (either in the camera 126 or within the system controller 102) may employ a pattern recognition algorithm to discern that similarly shaped objects (e.g., the nozzles 200A, 200B) are both tracing a circular pattern. Such an imaging system may also determine that relative to each other, the objects are phase shifted by 180° as they travel around the circumference of the circle being traced.

In step 310, an observed center point 202 may be determined based upon the two similarly shaped objects (e.g., the nozzles 200A, 200B) that were identified in step 308. In some embodiments, the observed center point 202 may be a point on the print head 108 that is equidistant from the identified similarly shaped objects (e.g., the nozzles 200A, 200B) that lies on a line projected between the two identified similarly shaped objects. In other words, the observed center point 202 may be a point on the print head 108 half-way between the two identified nozzles 200A, 200B on a line drawn connecting the two identified nozzles 200A, 200B.

In step 310, the observed center point 202 may be used to calibrate the print head drive mechanism 120. In some embodiments, the system controller 102 and/or the print head drive mechanism 120 may, for example, employ a coordinate system to track the location of the print head 108 as it is moved during printing and/or maintenance operations. Thus, at any location, the system controller 102 may have an "expected" value for the center point of the print head 108 based upon the coordinate system. In some embodiments, the observed center point 202 may be used to correlate and/or correct the expected value of the center point of the print head 108. For example, if the system controller 102 has tracked the print head center point and has a stored distance value of 4321 microns from a reference point along the X-axis for a current position, but through the use of the imaging system and the present invention it is determined that the current position of the print head center point is actually 4323 microns from the reference point along the X-axis, the system controller 102 may correct the coordinate system by the 2 micron difference along the X-axis.

In some embodiments, the camera 128 aimed at the substrate 114 may be used to locate the precise position of the print heads 108, 110, 112. The camera 128 may capture an image of a position reference mark on the stage 118 and/or on the substrate 114. This information may be transmitted to the system controller 102 which may use the information to compute the position of the camera 128 relative to the stage 118 and/or the substrate 114. The position of the print heads 108, 110, 112 may then be determined based upon a known offset from the position of the camera. In some embodiments, the image may include an ink drop deposited by a known one of the print heads. This information may alternatively or additionally be used to compute the position of the print heads.

The foregoing description discloses only particular embodiments of the invention; modifications of the above disclosed methods and apparatus which fall within the scope of the invention will be readily apparent to those of ordinary skill in the art. For example, in some embodiments, a line projected between the identified nozzles 200A, 200B may be compared against one or more reference lines of known orientations to determine the rotational orientation or alignment of the print head 108. This information may also be used by the system controller 102 to calibrate the print head drive mechanism 120.

Further, although the above example methods are F applied to only one print head 108, one of ordinary skill in the art would understand that these methods may be applied to each of the print heads 108, 110, 112, as well as the camera 128 and/or any other additional print heads.

In some embodiments, the apparatus and methods of the present invention may be applied to semiconductor processing and/or electronic device manufacturing. For example, resist patterns may be jetted onto substrates which may include glass, polymers, semiconductors, and/or any other suitable materials that are practicable. Thus, the jetted material may include ink, polymers, or any other suitable material that is practicable.

Accordingly, while the present invention has been disclosed in connection with specific embodiments thereof, it should be understood that other embodiments may fall within the spirit and scope of the invention, as defined by the following claims.

What is claimed is:

1. A system comprising:

a stage for moving a substrate relative to print heads during printing;

at least one print head suspended from a support above the stage, the at least one print head being moveable in a plane above the stage;

a controller operable to rotate the print head about a center of the print head; and an imaging system for capturing an image of the print head, and wherein the imaging system uses one or more controllers for determining a center point of the print head based upon images of the print head captured as the print head is rotated.

2. The system of claim 1 wherein the at least one print head rotates in a horizontal plane.

3. The system of claim 1 wherein the imaging system includes a camera aimed upward.

4. The system of claim 3 wherein the camera is positioned below a level of a surface of the stage.

5. The system of claim 1 wherein the imaging system identifies at least two nozzles on the print head that trace substantially similar circular paths phase shifted by 180° on the horizontal plane as the head is rotated and determines a center point of the print head based upon the two nozzles.

6. An apparatus comprising:

a camera for capturing images of a print head;

a processor coupled to the camera and operable to store images of the print head from the camera; and a memory coupled to the processor, wherein the memory stores processor instructions for capturing an image of the print head and for determining a center point of the print head based upon images of the print head captured as the print head is rotated.

7. The apparatus of claim 6 wherein the print head rotates in a horizontal plane.

8. The apparatus of claim 6 wherein the camera is aimed upward.

9. The apparatus of claim 6 wherein the camera is positioned adjacent to and below a stage for moving a substrate.

10. The apparatus of claim 6 wherein the camera is positioned below a stage for moving a substrate.

11. The apparatus of claim 6 wherein the processor identifies at least two nozzles on the print head that trace substantially similar circular paths as the head is rotated and determines a center point of the print head based upon the two nozzles.

12. The apparatus of claim 6 wherein the memory further stores processor instructions to:

transmit a print head rotation request to a print head drive mechanism;

identify at least two nozzles on the print head that trace substantially similar circular paths phase shifted by 180° on a horizontal plane above the camera as the print head is rotated; and determine a center point of the print head based upon the two nozzles.

13. An apparatus comprising:

a camera for capturing images of a print head;

a processor coupled to the camera and operable to store images of the print head from the camera; and a memory coupled to the processor, wherein the memory stores processor instructions to:

transmit a print head rotation request to a print head drive mechanism;

identify at least two nozzles on the print head that trace substantially similar circular paths phase shifted by 180° on a horizontal plane above the camera as the print head is rotated;

determine a center point of the print head based upon the two nozzles; and calibrate the print head drive mechanism based on the determined center point.

14. A method comprising:

transmitting a print head rotation request to a print head drive mechanism;

capturing images of the print head as the print head is rotated; and determining a center point of the print head based upon the images.

15. The method of claim 14 further comprising:

calibrating the print head drive mechanism based upon the determined center point.

16. The method of claim 14 further comprising:

moving a print head above a camera coupled to an imaging system.

17. The method of claim 14 wherein determining a center point of the print head includes identifying at least two nozzles on the print head that trace substantially similar circular paths phase shifted by 180° on a horizontal plane as the print head is rotated.

18. The method of claim 17 wherein determining a center point of the print head includes determining a point on the print head that is substantially equidistant from the two identified nozzles.

* * * * *